US005443193A

United States Patent [19]

Lenard

[11] Patent Number: 5,443,193

[45] Date of Patent: Aug. 22, 1995

[54] PAGER CARRIER WITH COIN DISPENSER

[76] Inventor: Mark D. Lenard, 5030 Wishing Well, Grand Blanc, Mich. 48439

[21] Appl. No.: 275,438

[22] Filed: Jul. 15, 1994

[51] Int. Cl.[6] ..... A45F 5/00

[52] U.S. Cl. ..... 224/252; 224/196; 206/0.81; 453/29

[58] Field of Search ..... 224/252, 253, 196; 206/0.80, 0.81, 305, 320; 453/29, 37

[56] References Cited

U.S. PATENT DOCUMENTS

| | | | |
|---|---|---|---|
| 216,068 | 6/1879 | Thurston | 206/0.81 |
| 315,303 | 4/1885 | Lambert | 224/253 |
| 575,007 | 1/1897 | Rappaport | 224/253 |
| 1,179,007 | 4/1916 | Hoover | 206/0.81 |
| 1,479,611 | 1/1924 | Jones | 206/0.81 |
| 1,574,644 | 2/1926 | Fiering et al. | 206/0.81 |
| 1,691,872 | 11/1928 | Sims | 206/0.81 |
| 1,701,595 | 2/1929 | Taylor | 206/0.81 |
| 1,981,975 | 11/1934 | Weimar | 150/37 |
| 2,429,661 | 10/1947 | Amsterdam | 150/37 |
| 2,436,646 | 2/1948 | Henne | 150/35 |
| 2,487,090 | 11/1949 | Bamberger | 206/0.81 |
| 2,644,471 | 7/1953 | Brown | 453/50 |
| 3,162,478 | 7/1966 | Amsterdam | 150/37 |
| 3,657,909 | 4/1972 | Boswell | 206/0.81 |
| 3,956,701 | 5/1976 | James, Jr. et al. | 224/252 |
| 4,113,157 | 9/1978 | Woodbury | 224/163 |
| 4,190,148 | 2/1980 | Schade, II et al. | 224/196 |
| 4,479,596 | 10/1984 | Swanson | 224/236 |
| 4,534,063 | 8/1985 | Krumin et al. | 224/196 |
| 4,779,568 | 10/1988 | Finger, Jr. | 206/0.81 |
| 4,802,241 | 1/1989 | Vickers et al. | 224/196 |
| 4,951,817 | 8/1990 | Barletta et al. | 206/305 |
| 5,081,709 | 1/1992 | Benyo | 455/348 |
| 5,152,399 | 10/1992 | Keenaghan et al. | 206/0.81 |

FOREIGN PATENT DOCUMENTS

| | | | |
|---|---|---|---|
| 908455 | 10/1962 | United Kingdom | 206/0.81 |

*Primary Examiner*—J. Casimer Jacyna
*Assistant Examiner*—Charles R. Eloshway
*Attorney, Agent, or Firm*—Charles W. Chandler

[57] ABSTRACT

A combination carrying case for a portable electronic pager and a coin dispenser includes an upright case body in which the front wall and one side wall have a reduced height, so that the pager is easily inserted into the receptacle defined by the case body. The coin dispenser includes a vertical coin chute integral with one side wall of the case body so that the chute has a relatively large coin capacity. Coins are extracted from the chute through a coin slot at the lower end of the chute. A spring clip is provided on the rear wall of the case for detachably mounting the case on the user's belt.

1 Claim, 1 Drawing Sheet

PAGER CARRIER WITH COIN DISPENSER

BACKGROUND OF THE INVENTION

This invention is related to a combination carrying case for a portable electronic pager and a coin dispenser.

Electronic pagers are commonly carried by a clip mounted on the user's belt. The carrying case comprises a body having an open topped receptacle. Pagers are useful because they signal a message to the user when he is away from his office. However, a problem with such an arrangement is that the user then must contact his office by telephone. He frequently must use a pay telephone. Under such circumstances he is handicapped if he does not have coins to use in the pay telephone.

Electronic pager carriers may be found in the prior art, for example, U.S. Pat. No. 4,479,596 which was issued Oct. 30, 1984 to Albert W. Swanson for "Carrying Case for Portable Electronic Paging Devices"; and U.S. Pat. No. 5,081,709 which was issued Jan. 14, 1992, to John R. Benyo for "Interchangeable Belt Clip for a Selective Call Receiver Housing and Carrying Case". Coin dispensers combined with receptacles or bags for carrying other items may be found in U.S. Pat. No. 1,981,975 which was issued Nov. 27, 1934, to Edward Weimar; U.S. Pat. No. 2,436,646 which was issued Feb. 24, 1948, to Isabelle Henne for "Combined Bag-Latch and Coin-Holder"; U.S. Pat. No. 2,429,661 which was issued Oct. 28, 1947, to Lilly Amsterdam for "Detachable Coin Dispenser for Ladies' Handbags" and U.S. Pat. No. 3,262,478 which was issued Jul. 26, 1966, to Lilly Amsterdam for "Coin Holder Pocketbook".

SUMMARY OF THE INVENTION

The broad purpose of the present invention is to provide a combination carrying case for an electronic pager and a coin dispenser. In the preferred embodiment of the invention, the carrying case comprises a body with an open top receptacle for receiving the pager, and a belt clip on the back wall of the body. A tubular housing is attached to one of the side walls of the pager carrier. The housing has a bottom exit for receiving and dispensing individual coins from a stack of coins contained in the housing.

Consequently, the user upon receiving a signal from the pager can use a pay telephone with the coins readily available.

Still further objects and advantages of the invention, will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
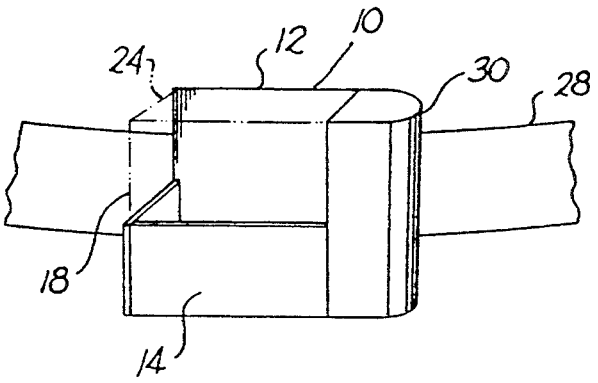
FIG. 1 illustrates a combination electronic page carrier and coin dispenser illustrating the preferred embodiment of the invention.
Figure 2:
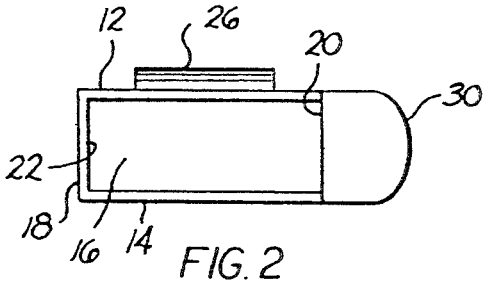
FIG. 2 is a top view of the preferred carrier.
Figure 3:
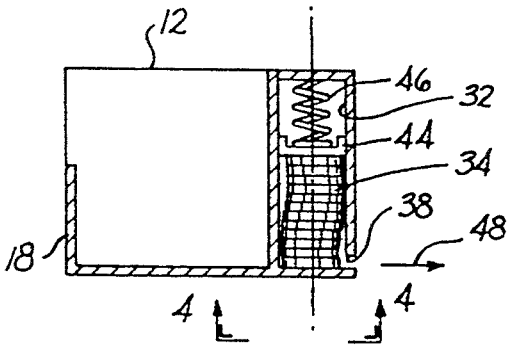
FIG. 3 is a elevational partially fragmentary view.
Figure 4:
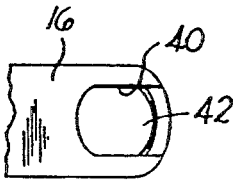
FIG. 4 is a view as seen along lines 4—4 of FIG. 3.

Referring to the drawings, FIG. 1 illustrates a preferred combination carrying case 10 which is preferably formed of a light weight plastic. Case 10 has a back wall 12, a front wall 14, a bottom wall 16, and a pair of side walls 18 and 20. The front, back and side walls define a receptacle having an open top 22 for receiving a conventional electronic pager 24, illustrated in phantom.

Figure 5:
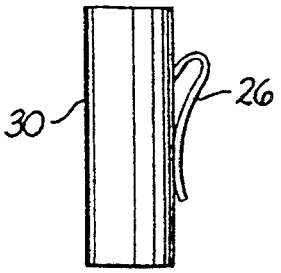
FIG. 5 is an end view of the preferred carrier.

Referring to FIG. 5, a resilient belt clip 26 is attached to back wall 12 for mounting the case on the user's belt 28 in the usual manner.

An elongated upright tubular housing 30 is integrally attached to side wall 20 and preferably has the same height as back wall 12. Housing 30 defines an elongated internal chamber 32. Chamber 32 has a cylindrical cross section with a diameter chosen to accommodate coins of a given denomination such as a stack 34 of dimes. The stack is axially moveable with respect to the longitudinal axis 36 of the chamber. The coins may be individually removed through a slot 38 which forms an exit opening at the bottom of the chamber. The bottom wall of the carrying case has a cut-out portion 40 opening to slot 38 so that the user remove an individual coin 42 by moving the coin with his finger in a lateral direction with respect to axis 36.

An axially moveable plug 44 is slidably mounted in the chamber. A coil spring 46 biases the plug which in turn engages and biases the stack of coins toward slot 38.

The coins may be inserted into the chamber through the exit opening by raising the stack against the bias of the spring and inserting the coin through slot 38 into the chamber. Several coins can be stacked in the chamber in this manner.

When the coins are to be removed, the bottom coin is removed in the direction of arrow 48.

Housing 30 can be an integral component of either side wall of the case or even in an appropriate location on the front or back walls.

The coin chamber can be dimensioned to receive coins of different denominations or mixed denominations.

It is further to be understood that the coins may be arranged in another storage configuration such as side-by-side, so long as the dispensing housing is attached to the pager carrying case.

Having described my invention, I claim:

1. A combination carrying case for a portable electronic pager and a coin dispenser, comprising:

a case body that includes a bottom wall, a front wall extending upwardly from said bottom wall, a first side wall extending upwardly from said bottom wall, a rear wall extending upwardly from said bottom wall, and a second side wall extending upwardly from said bottom wall, the distance between said front wall and said rear wall being less than the distance between said first and second side walls, whereby said walls form an upwardly open rectangular receptacle for receiving an electronic pager;

a resilient clip secured to said rear wall for detachably mounting said case body in an upright position on a user's belt;

said front wall, first side wall, rear wall, and second side wall having upper edges located above the bottom wall, the upper edges of said front wall and said first side wall being located below the upper edges of said rear wall and said second side wall so that the front wall and first side wall have a decreased height relative to the height of the rear wall and the second side wall, whereby when the pager is placed in the receptacle a front surface and one side surface of the pager are partially exposed, said second side wall being joined to said front wall and said rear wall to form a front corner and a rear corner;

a coin chute comprising an upright arcuate end wall joined to said second side wall at said front and rear corners, said coin chute further comprising a chute top wall located in a plane coincident with the upper edge of the case body rear wall, and a chute bottom wall located in a plane defined by the case body bottom wall, whereby the coin chute and case body are integrally joined together without projections or surface discontinuities; and said coin chute bottom wall having an upper surface for supporting a stack of coins in the chute; said upright arcuate end wall having a horizontal coin discharge slot communicating with the upper surface of the chute bottom wall; said chute bottom wall having a cut-out enabling a user's finger to draw a lowermost coin in the stack outwardly through said discharge slot.

* * * * *